US009115713B2

(12) United States Patent
Oikawa

(10) Patent No.: US 9,115,713 B2
(45) Date of Patent: Aug. 25, 2015

(54) HIGH-PRESSURE PUMP

(75) Inventor: Shinobu Oikawa, Kariya (JP)

(73) Assignee: DENSO CORPORATION, Kariya (JP)

( * ) Notice: Subject to any disclaimer, the term of this patent is extended or adjusted under 35 U.S.C. 154(b) by 991 days.

(21) Appl. No.: 13/082,840

(22) Filed: Apr. 8, 2011

(65) Prior Publication Data

US 2011/0247488 A1 Oct. 13, 2011

(30) Foreign Application Priority Data

Apr. 8, 2010 (JP) ..... 2010-89360
Nov. 25, 2010 (JP) ..... 2010-262312

(51) Int. Cl.

| | |
|---|---|
| ***F01B 31/00*** | (2006.01) |
| ***F04B 53/08*** | (2006.01) |
| ***F02M 59/44*** | (2006.01) |
| ***F02M 53/00*** | (2006.01) |
| ***F04B 1/04*** | (2006.01) |
| ***F04B 53/16*** | (2006.01) |

(Continued)

(52) U.S. Cl.

CPC ..... *F04B 53/08* (2013.01); *F02M 53/00* (2013.01); *F02M 59/44* (2013.01); *F04B 1/0404* (2013.01); *F04B 1/0421* (2013.01); *F04B 53/16* (2013.01); *F02M 37/0029* (2013.01); *F02M 37/0041* (2013.01); *F02M 37/0047* (2013.01); *F02M 59/102* (2013.01); *F02M 59/367* (2013.01); *F02M 63/0265* (2013.01)

(58) Field of Classification Search

CPC ..... F02M 37/0041; F02M 37/0047; F02M 37/043; F02M 59/027; F02M 59/44; F02M 59/466; F04B 1/0421; F04B 1/0404; F04B 53/16; F04B 53/08; F04M 53/00; F04M 59/367; F04M 59/102; F04M 37/0029; F04M 63/0265

USPC ..... 92/1; 82/144; 60/456; 123/456; 417/470

See application file for complete search history.

(56) References Cited

U.S. PATENT DOCUMENTS 5,600,958 A * 2/1997 Henning et al. ..... 62/60
7,707,996 B2 5/2010 Yamada et al.

(Continued)

FOREIGN PATENT DOCUMENTS

DE 103 22 599 A1 12/2004
JP 2008-002361 1/2008

(Continued)

OTHER PUBLICATIONS

Japanese Office Action dated Aug. 21, 2012, issued in corresponding Japanese Application No. 2010-262312 with English translation.

(Continued)

*Primary Examiner* — Dwayne J White
*Assistant Examiner* — Logan Kraft
(74) *Attorney, Agent, or Firm* — Nixon & Vanderhye P.C.

(57) ABSTRACT

A high-pressure pump includes a plunger for pressurizing a fuel, a cylinder accommodating the plunger reciprocatably in its axial direction and a pump body. The pump body defines a pressurization chamber, a low-pressure fuel passage hydraulically connecting a fuel inlet and the pressurization chamber, and a discharge passage. The pump body further defines a cylindrical space around the cylinder. The fuel flows into the cylindrical space from the low-pressure fuel passage so as to cool the cylinder. The entire outer surface of the cylinder can be surely cooled.

10 Claims, 12 Drawing Sheets

(51) Int. Cl.

| | |
|---|---|
| *F02M 37/00* | (2006.01) |
| *F02M 59/36* | (2006.01) |
| *F02M 63/02* | (2006.01) |
| *F02M 59/10* | (2006.01) |

(56) References Cited

U.S. PATENT DOCUMENTS

| | | | | |
|---|---|---|---|---|
| 7,905,215 | B2 | 3/2011 | Suzuki et al. | |
| 8,070,462 | B2 * | 12/2011 | Inoue | 417/307 |
| 2003/0017069 | A1 * | 1/2003 | Usui et al. | 417/571 |
| 2005/0100466 | A1 * | 5/2005 | Aoki et al. | 417/533 |

FOREIGN PATENT DOCUMENTS

| | | |
|---|---|---|
| JP | 2008-525713 | 7/2008 |
| JP | 2010-106741 | 5/2010 |

OTHER PUBLICATIONS

Office Action (2 pages) dated Aug. 6, 2013, issued in corresponding Japanese Application No. 2010-219154 (which is a divisional of JP 2010-262312) and English translation (2 pages).

* cited by examiner

HIGH-PRESSURE PUMP

CROSS-REFERENCE TO RELATED APPLICATION

This application is based on Japanese Patent Applications No. 2010-89360 filed on Apr. 8, 2010 and No. 2010-262312 filed on Nov. 25, 2010, the disclosures of which are incorporated herein by reference.

FIELD OF THE INVENTION

The present invention relates to a high-pressure pump used for an internal combustion engine.

BACKGROUND OF THE INVENTION

Conventionally, a fuel supply system which supplies fuel to an engine is equipped with a high-pressure pump which pressurizes the fuel suctioned from a fuel tank. The pressurized fuel discharged from the high-pressure pump is accumulated in a delivery pipe and is injected into a cylinder through an injector. Generally, a high-pressure pump is installed on an engine head. The high-pressure pump is comprised of a plunger and a cylinder. The plunger reciprocates in the cylinder to pressurize the fuel in a pressurization chamber.

Such a high-pressure pump receives heat from the engine, which may cause a deformation of the cylinder. The deformation of the cylinder gradually increases frictional heat between the cylinder and the plunger. It is likely that seizure may occur between the cylinder and the plunger. If the seizure occurs, a fuel pressure in a delivery pipe may be decreased and no fuel may be injected through a fuel injector. Finally, the engine may be stopped.

Patent Document 1 (JP-2008-2361A) shows that a high-pressure pump has a cylindrical bush made of heat-resistant material. This cylindrical bush is provided to a pump body through a cylinder holder and functions as cylinder, whereby a deformation of the cylinder is restricted.

Patent Document 2 (JP-2003-35239A) describes that a cylinder holder is made of material whose thermal conductivity is small and a thread portion of the cylinder holder is coated with resin, whereby heat transfer from a pump body to a cylinder is restricted.

Patent Document 3 (JP-2008-525713A) and Patent Document 4 (DE-10322599A) show that a cylinder is made of material which has high heat-resisting property, whereby it is restricted that the cylinder is deformed.

Patent Document 5 (JP-2010-106741A) shows a high-pressure pump which has a variable volume chamber on an opposite side of a pressurization chamber. A cylinder has a plurality of grooves on its outer surface. The fuel flows in and flows out from the variable volume chamber through these grooves, so that the cylinder is cooled by the fuel.

Patent Document 6 (US-77079966B2) shows a high-pressure pump which has a cylindrical clearance gap around a cylinder. This cylindrical clearance gap communicates with a pressurization chamber and a low-pressure fuel passage.

In the high-pressure pump shown in Patent Documents 1-4, a cylinder, a cylinder holder and a pump body are formed from separate pieces, which increases a number of parts. Further, the cylinder holder is made of low-heat-conductivity material and the thread portion of the cylinder holder is coated with resin material, which make the structure complicated and increases manufacturing steps.

Also, since the cylinder, the cylinder holder and the pump body are in contact with each other on their outer surfaces, it is likely that engine radiant heat may be transferred from the pump body to the cylinder.

In the high-pressure pump shown in Patent Document 5, since the grooves are formed around only one end portion of the cylinder, the entire cylinder is not always cooled.

The high-pressure pump shown in Patent Document 6 has no variable volume chamber. The cylindrical clearance gap communicates with only the low-pressure fuel passage. Thus, it is less likely that the fuel circulates to cool the cylinder.

SUMMARY OF THE INVENTION

The present invention is made in view of the above matters, and it is an object of the present invention to provide a high-pressure pump capable of enhancing a cooling efficiency of a cylinder.

According to a high-pressure pump of the present invention, a cylinder accommodates a plunger slidably. A pump body defines a pressurization chamber in which the fuel is pressurized by the plunger, a low-pressure fuel passage hydraulically connecting a fuel inlet and the pressurization chamber, and a discharge passage hydraulically connecting the pressurization chamber and a fuel outlet. A suction valve opens/closes a low-pressure fuel passage. A discharge valve opens/closes a discharge passage. The pump body further defines a cylindrical space around the cylinder, and the fuel flows into the cylindrical space from the low-pressure fuel passage. The cylindrical space is always filled with the fuel of low temperature.

Thus, the entire cylinder is cooled by the fuel flowing in the cylindrical space, which restricts a deformation of the cylinder. A fuel leakage and a seizure between the cylinder and the plunger can be restricted.

BRIEF DESCRIPTION OF THE DRAWINGS

Other objects, features and advantages of the present invention will become more apparent from the following description made with reference to the accompanying drawings, in which like parts are designated by like reference numbers and in which.

Figure 11:
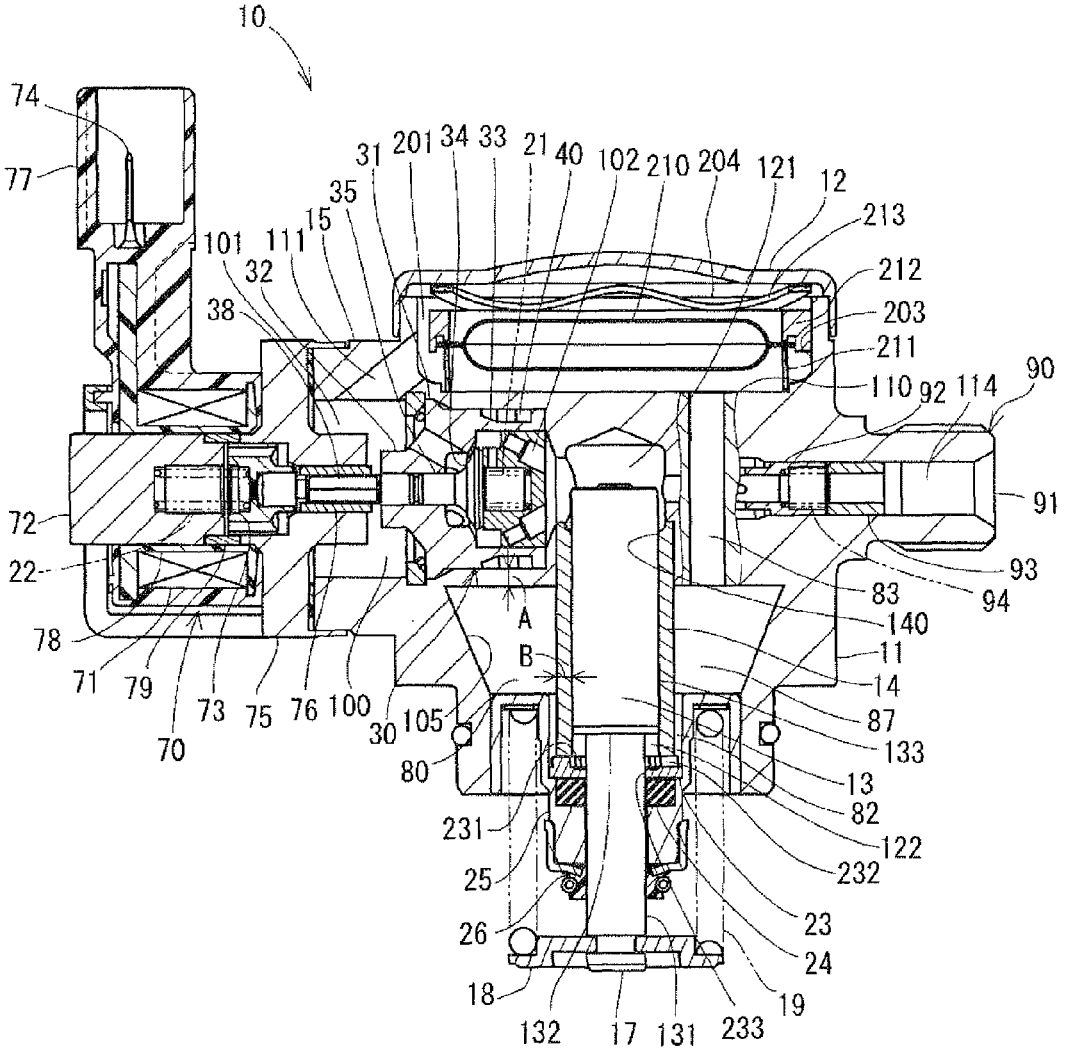
Figure 12:
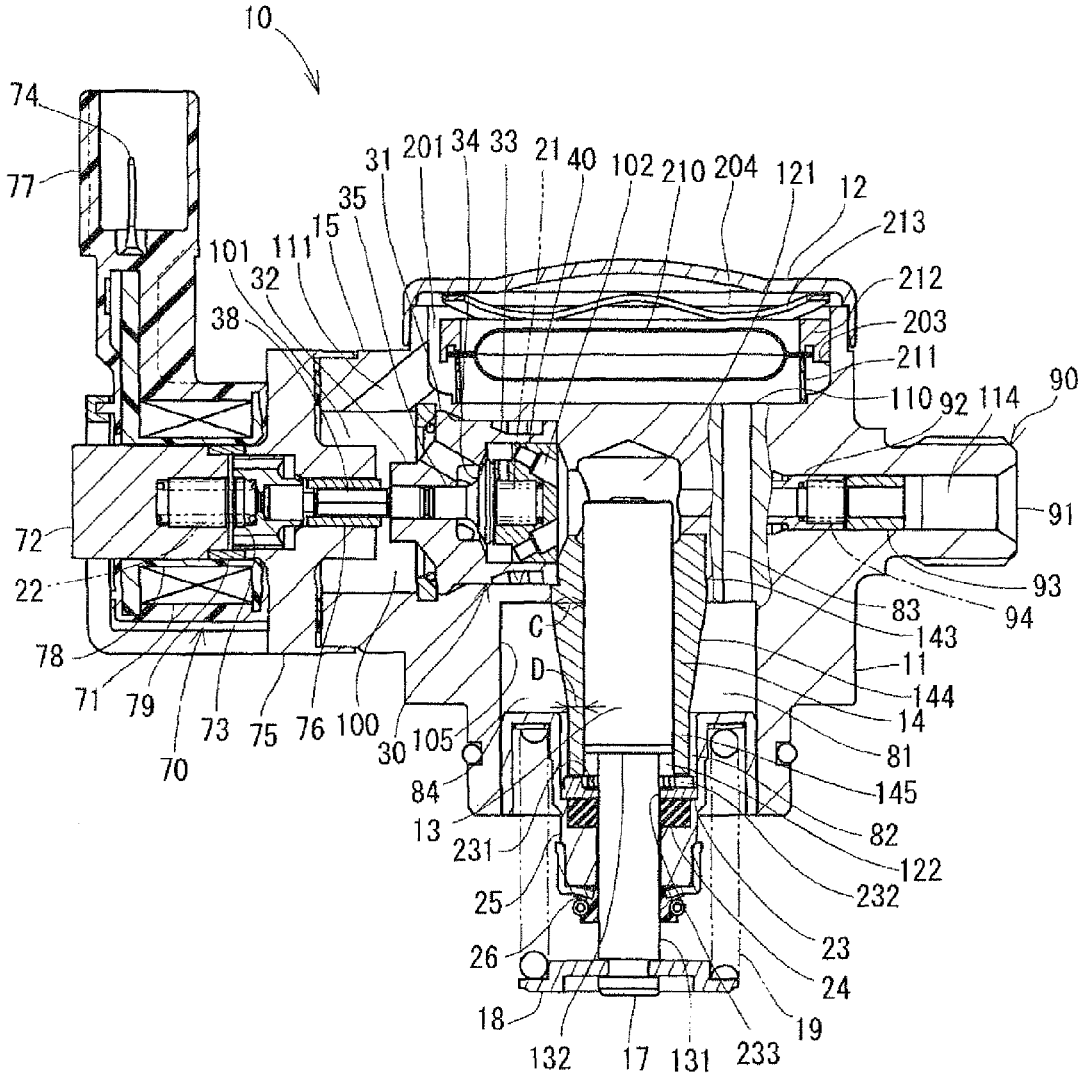

FIG, 10 is a cross-sectional view showing a high-pressure pump according to a sixth embodiment of the invention;

FIG. 11 is a cross-sectional view showing a high-pressure pump according to a seventh embodiment of the invention; and FIG. 12 is a cross-sectional view showing a high-pressure pump according to an eighth embodiment of the invention.

DETAILED DESCRIPTION OF EMBODIMENTS

Hereafter, embodiments of the present invention will be described hereinafter.

[First Embodiment]

Figure 1:
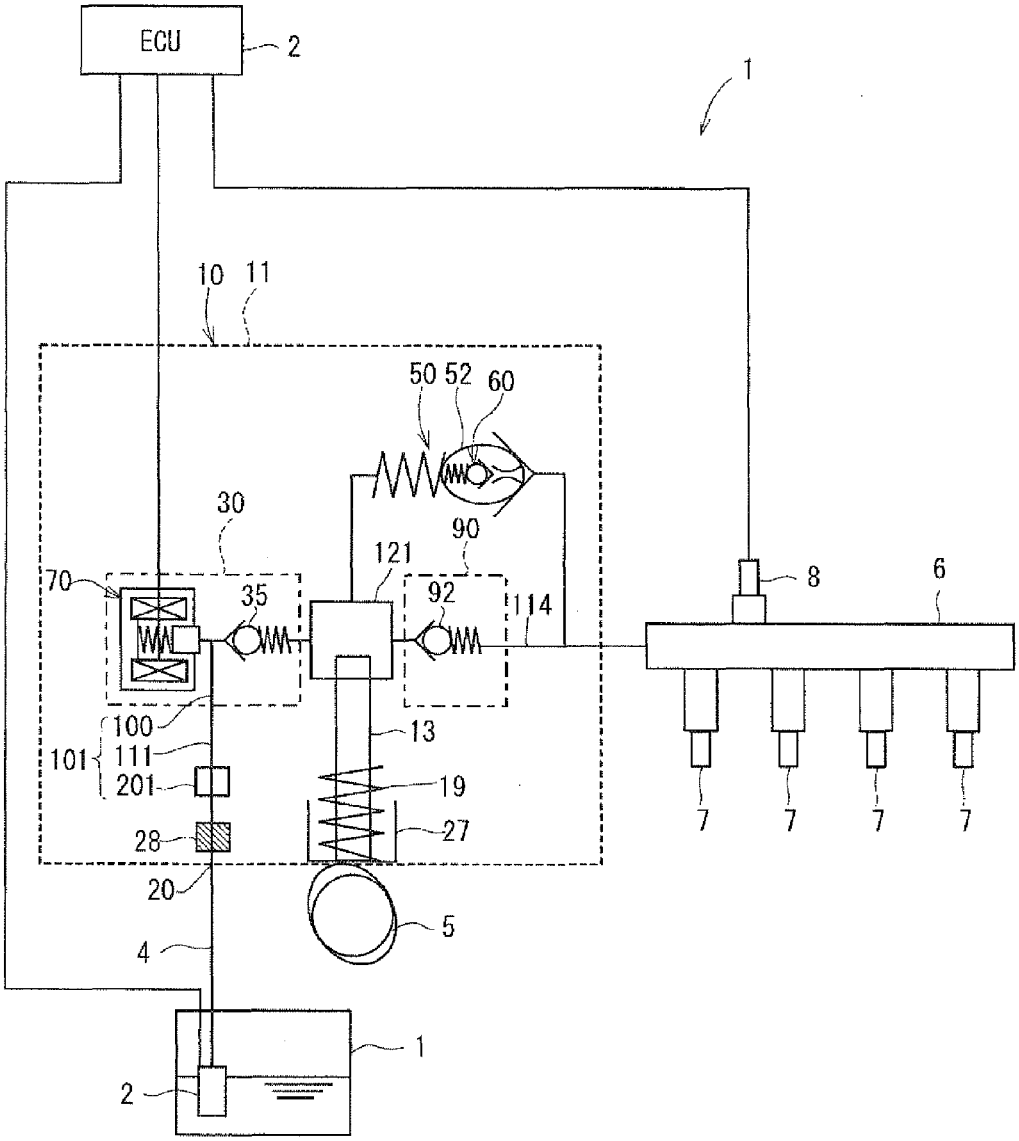
FIG. 1 is a schematic diagram showing a fuel supply system to which a high-pressure pump is applied, according to a first embodiment.

FIG. 1 is a schematic view showing a fuel supply system including a high-pressure pump according to a first embodiment.

A portion encompassed by a dashed line represents a pump body 11 of a high-pressure pump 10. Fuel in a fuel tank 1 is pumped up by a low-pressure pump 3 according to a command signal from an electronic control unit (ECU) 2. The fuel is introduced to a fuel inlet 20 of a high-pressure pump 10 through a low-pressure fuel pipe 4.

The fuel passed through the fuel inlet 20 flows into a supply passage 100 of a suction valve 30 through a filter 28, a damper chamber 201 and an introduction passage 111. The filter 28 removes foreign matters contained in the fuel. The damper chamber 201 attenuates pressure pulsation. In the present embodiment, a passage including a fuel passage between the fuel inlet 20 and the damper chamber 201, the damper chamber 201, the introduction passage 111, and the supply passage 100 is referred to as a low-pressure fuel passage 101.

The suction valve 30 opens/closes the supply passage 100 receiving hydraulic pressure in the supply passage 100 and magnetic force from a solenoid portion 70. The fuel suctioned into a pressurization chamber 121 is pressurized by a plunger 13 which reciprocates along with a camshaft 5. When a discharge valve 90 is opened, the pressurized fuel in the pressurization chamber 121 is discharged into a discharge passage 114 through a fuel outlet 91. A configuration and an operation of the high-pressure pump 10 will be described later.

The fuel discharged from the high-pressure pump 10 is introduced into a common-rail 6. Fuel injectors 7 and a fuel pressure sensor 8 are provided to the common-rail 6.

Figure 2:
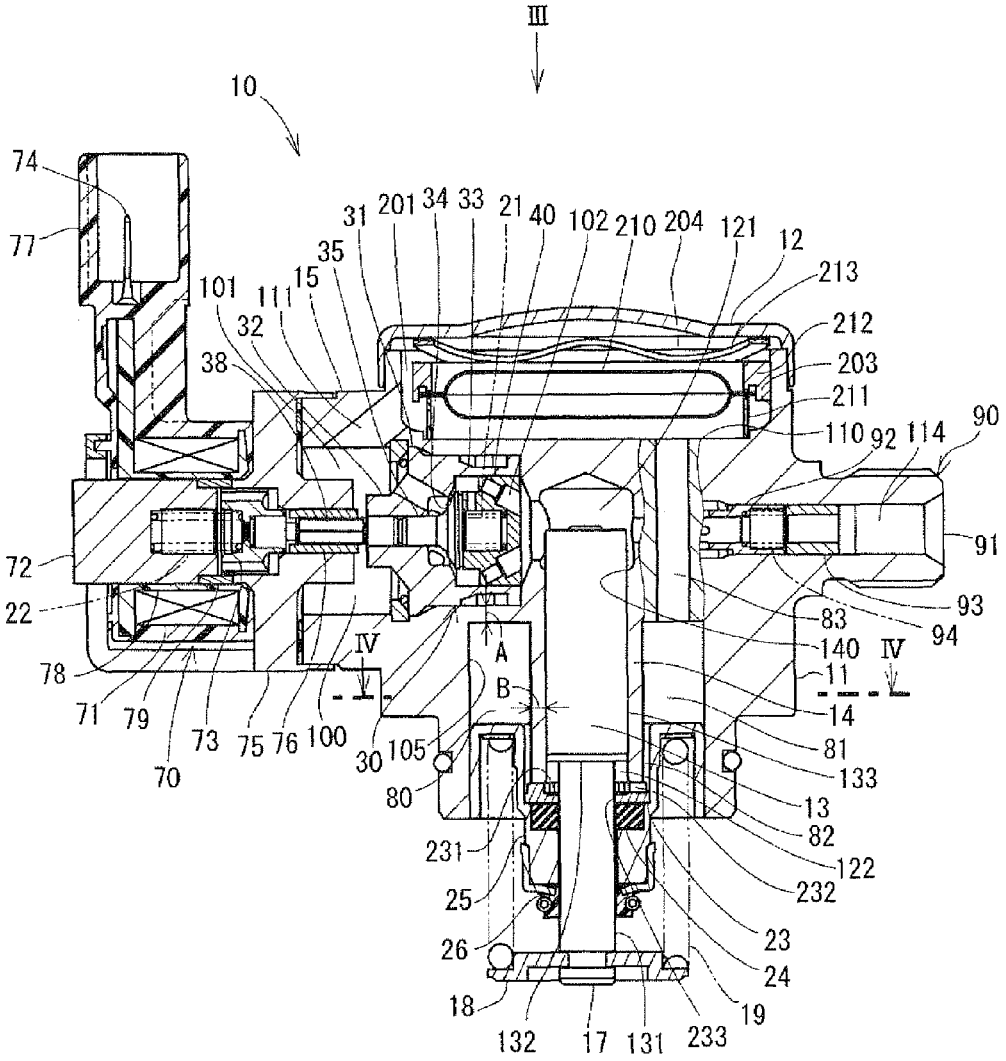
FIG. 2 is a cross-sectional view showing a high-pressure pump according to the first embodiment of the invention.
Figure 3:
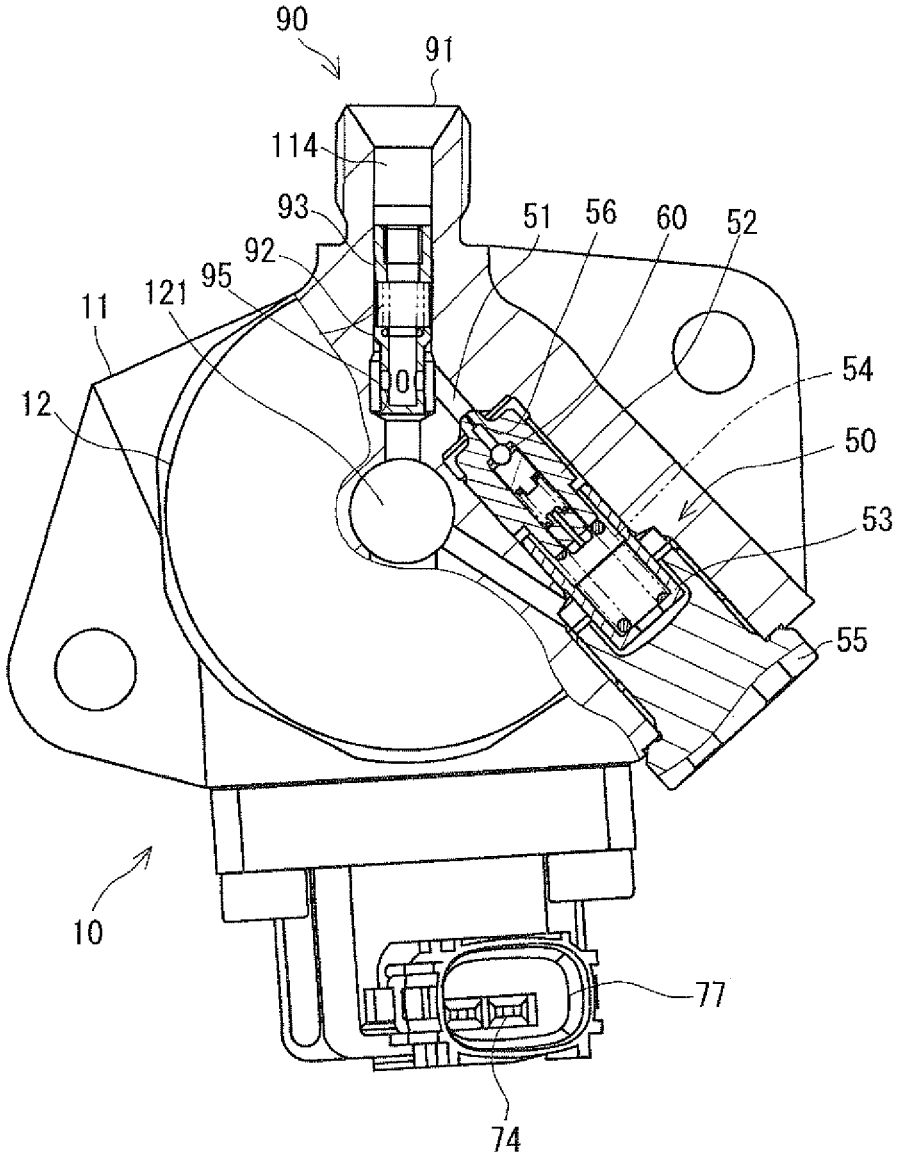
FIG. 3 is a partly sectional view in a direction of an arrow III in FIG. 2.
Figure 4:
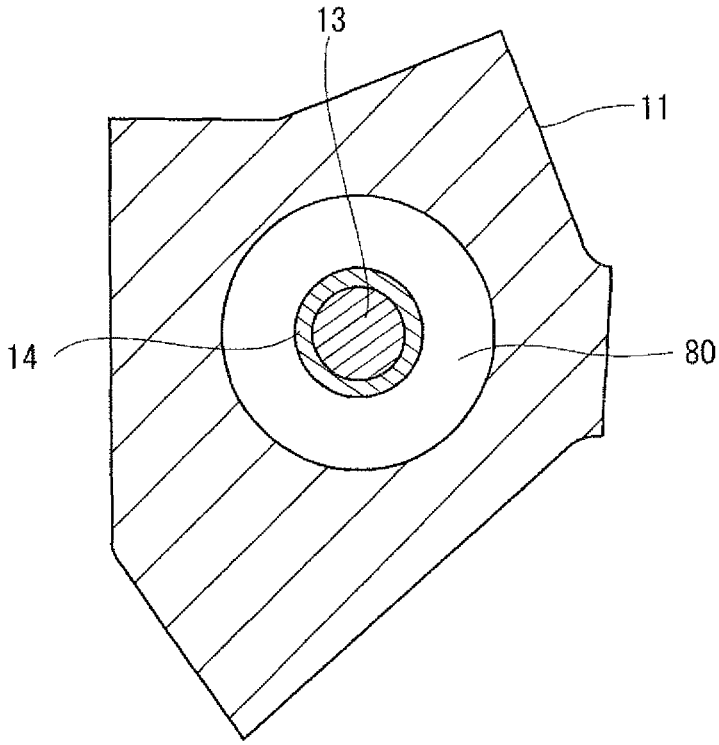
FIG. 4 is a cross-sectional view taken along line IV-IV in FIG. 2.

A configuration and an operation of the high-pressure pump 10 will be described in detail. As shown in FIGS. 2 and 3, the high-pressure pump 10 is provided with a pump body 11, a plunger 13, a damper chamber 201, a suction valve 30, a solenoid portion 70, a discharge valve 90 and a pressure regulating portion 50.

The pump body 11 forms a cylinder 14 therein. The cylinder 14 receives the plunger 13 reciprocatably. The plunger 13 has a head 17 with which a spring seat 18 is engaged. A spring 19 is provided between the spring seat 18 and an oil-seal holder 25. One end of the spring 19 is engaged with the oil-seal holder 25 and the other end is engaged with the spring seat 18. The spring 19 biases the spring seat 18 toward the camshaft 5. The plunger 13 is in contacted with the camshaft 5 through a tappet 27, so that the plunger 13 reciprocates to pressurize the fuel in the pressurization chamber 121.

Next, the damper chamber 201 will be described in detail.

The pump body 11 has a concave portion 203. A lid member 12 covers an opening 204 of the concave portion 203. The lid member 12 and the concave portion 203 define the damper chamber 201 therebetween.

The damper chamber 201 accommodates a pulsation damper 210, a first supporting member 211, a second supporting member 212, and a wavy spring 213. The pulsation damper 210 is comprised of two metallic diaphragms in which air of specified pressure is sealed. The pulsation damper 210 reduces fuel pressure pulsation in the damper chamber 207.

The first supporting member 211 is cylindrically shaped and has a plurality of apertures through which the fuel flows. The first supporting member 211 is engaged with a bottom concave 110 of the pump body 11. The second supporting member 212 is also cylindrically shaped. The pulsation damper 210 is sandwiched between the first supporting member 211 and the second supporting member 212.

The wavy spring 213 is arranged between the second supporting member 212 and the lid member 12 so that the second supporting member 212 is biased toward the pump body 11. Thereby, the pulsation damper 210, the first supporting member 211 and the second supporting member 212 are fixed in the damper chamber 201.

The damper chamber 201 communicates with a fuel inlet (not shown) through a fuel passage (not shown). The fuel in the fuel tank 1 is supplied to the fuel inlet. The fuel in the fuel tank 1 is introduced into the damper chamber 201.

Next, the suction valve 30 will be described in detail.

The pump body 11 has a cylindrical body portion 15 which extends perpendicularly relative to a center line of the cylinder 14. The cylindrical body portion 15 defines the supply passage 100 therein. One end of the supply passage 100 is hydraulically connected to the pressurization chamber 121. The damper chamber 201 and the supply passage 100 are connected with each other through the introduction passage 111. The fuel is introduced into the pressurization chamber 121 through a passage between the fuel inlet and the damper chamber 201, the damper chamber 201, the introduction passage 111 and the supply passage 100.

The valve body 31 is accommodated in the supply passage 100. The valve body 31 has a small-diameter cylinder portion 32 and a large-diameter cylinder portion 33. The large-diameter cylinder portion 33 has a valve seat 34. The suction valve body 35 is arranged inside of the large-diameter cylinder portion 33. The suction valve body 35 slides on an inner surface of the small-diameter cylinder portion 32. The suction valve body 35 can sit on the valve seat 34.

A stopper 40 is fixed on an inner surface of the large-diameter cylinder portion 33 to restrict a movement of the suction valve body 35 in its opening direction. A first spring 21 is provided between the stopper 40 and the suction valve body 35. The first spring 21 biases the suction valve body 35 toward the valve seat 34. The stopper 40 has a plurality of inclined passages 102.

Next, the solenoid portion 70 will be described hereinafter.

The solenoid portion 70 is comprised of a coil 71, a fixed core 72, a movable core 73, and a flange 75. A coil 71 is wound around a spool 78 made of resign. The fixed core 72 is made from magnetic material and is accommodated inside of the coil 71. The movable core 73 is made from magnetic material and confronts the fixed core 72. The movable core 73 is slidably arranged in a flange 75.

The flange 75 is made of magnetic material and is attached to the cylindrical body portion 15. A cylindrical member 79 made of nonmagnetic material is disposed between the fixed core 72 and the flange 75 to prevent a magnetic short circuit therebetween. The flange 75 supports the fixed core 72 and the connector 77 on the pump body 11 and closes an opening end of the cylindrical body portion 15. The flange 75 is provided with a guide cylinder 76. A needle 38 is slidably arranged in the guide cylinder 76. One end of the needle 38 is connected to the movable core 73 and the other end is engaged with the suction valve body 35.

A second spring 22 is provided between the fixed core 72 and the movable core 73. The second spring 22 biases the movable core 73 toward the suction valve body 35 with a biasing force which is grater than a biasing force of the first spring 21. When the coil 71 is not energized, the movable core 73 and the fixed core 72 are apart from each other by the biasing force of the second spring 22. Thereby, the movable core 73 and the needle 38 are moved toward the suction valve body 35, so that the needle 38 pushes the suction valve body 35 to be opened.

A variable volume chamber 122 will be described hereinafter.

The plunger 13 has a small-diameter portion 131 and a large-diameter portion 133. A stepped surface 132 is formed between the small-diameter portion 131 and the large-diameter portion 133. An annular plunger stopper 23 is provided to the stepped surface 132. The plunger stopper 23 has a concave portion 231 and grooves 232 which radially extend from the concave portion 231. The plunger stopper 23 has a through hole 233 at its center. The small-diameter portion 131 is inserted into the through hole 233.

The pump body 11 has an annular concave portion 105. An oil-seal holder 25 is inserted into the annular concave portion 105. The small-diameter portion 131 is surrounded by the oil-seal holder 25. The oil-seal holder 25 is fixed on an inner surface of the annular concave portion 105 through the seal member 24. The seal member 24 regulates the thickness of the fuel around the small-diameter portion 131 to avoid a fuel leakage. An oil seal 26 is provided to the oil-seal holder 25. The oil seal 26 regulates the thickness of the oil around the small-diameter portion 131 to avoid an oil leakage.

A variable volume chamber 122 is defined by the stepped surface 132, the outer wall surface of the small-diameter portion 131, an inner wall surface of the cylinder 14, the concave portion 231, the grooves 232 and an annular space surrounded by the seal member 24.

A cylindrical space 80 is defined between the inner wall of the oil-seal holder 25 and the inner wall of the annular concave portion 105. The cylindrical space 80 is coaxially formed around the cylinder 14. The cylindrical space 80 is comprised of a first cylindrical space 81 and a second cylindrical space 82. The first cylindrical space 81 is formed around the cylinder 14 and the second cylindrical space 82 is formed between an inner wall surface of the oil-seal holder 25 and the outer wall surface of the cylinder 14. The first cylindrical space 81 communicates with the damper chamber 201 through a communication passage 83 which is defined in the pump body 11. The second cylindrical space 82 communicates with the variable volume chamber 122 through the grooves 232. Thereby, the cylindrical space 80 communicates with both the damper chamber 201 and the variable volume chamber 122.

The cylindrical space 80 axially extends from the variable volume chamber 122 toward the pressurization chamber 121 around the cylinder 14. If a wall thickness "A" between the supply passage 100 and the cylindrical space 80 is made thin, it is likely that the inner wall of the pump body 11 defining the supply passage 100 may be deformed due to the fuel pressure in the supply passage 100. If the supply passage 100 is deformed, clearance gaps are generated in the suction valve 30, which causes fuel leakage. Therefore, according to the present embodiment, the wall thickness "A" is defined in such a manner that the supply passage 100 is hardly deformed due to the fuel pressure in the supply passage 100.

Also, if a wall thickness "B" of the cylinder 14 is made small, it is likely that the cylinder 14 may be deformed due to a fuel pressure between the cylinder 14 and the plunger 13. According to the present embodiment, the wall thickness "B" is defined in such a manner that the cylinder 14 is hardly deformed due to the fuel pressure between the cylinder 14 and the plunger 13.

Then, the discharge valve 90 will be described hereinafter.

The discharge valve 90 controls a discharge of fuel pressurized in the pressurization chamber 121. The discharge valve 90 is comprised of a discharge valve body 92, a regulation member 93, a spring 94 and like. The pump body 11 defines a discharge passage 114 which extends perpendicularly relative to the center axis of the cylinder 14. The discharge passage 114 hydraulically connects the pressurization chamber 121 and the fuel outlet 91. The discharge valve body 92 is cup-shaped and is slidably accommodated in the discharge passage 114. As shown in FIG. 3, when the discharge valve body 92 sits on the valve seat 95, the discharge passage 114 is closed. The regulation member 93 is fixed on an inner wall surface of the discharge passage 114. One end of the spring 94 is engaged with the regulation member 93 and the other end is engaged with the discharge valve body 92. The spring 94 biases the discharge valve body 92 toward the pressurization chamber 121.

When the fuel pressure in the pressurization chamber 121 exceeds a specified value, the discharge valve body 92 moves away from the valve seat 95, whereby the fuel in the pressurization chamber 121 is discharged through the fuel outlet 91.

When the fuel pressure in the pressurization chamber 121 is decreased, the discharge valve body 92 seats on the valve seat 95. Thereby, a reverse flow of the fuel from the fuel outlet 91 toward the pressurization chamber 121 is avoided.

Referring to FIG. 3, the pressure regulating portion 50 will be described hereinafter.

The pump body 11 has a relief passage 51 which extends perpendicularly relative to the center axis of the cylinder 14. One end of the relief passage 51 is hydraulically connected to both the discharge passage 114 and the pressurization chamber 121. A plug 55 closes an opening of the relief passage 51 at an outside wall of the pump body 11. The pressure regulating portion 50 is comprised of a relief valve 52, an adjustment pipe 53, a spring 54, and a constant residual pressure valve 60.

The relief valve 52 is formed cylindrical and is slidably arranged in the relief passage 51. The relief valve 52 has an inner passage in which the constant residual pressure valve 60 is accommodated. One end of the spring 54 is engaged with the relief valve 52, and the other end is engaged with the adjustment pipe 53. The relief valve 52 is biased toward a valve seat 56 by the spring 54. When the relief valve 52 sits on the valve seat 56, the relief passage 51 is closed. When the relief valve 52 moves apart from the valve seat 56, the relief passage 51 is opened.

The adjustment pipe 53 adjusts a load of the spring 54.

The constant residual pressure valve 60 is a check valve which opens when the fuel pressure in the delivery pipe is greater than a specified value.

Figure 5:
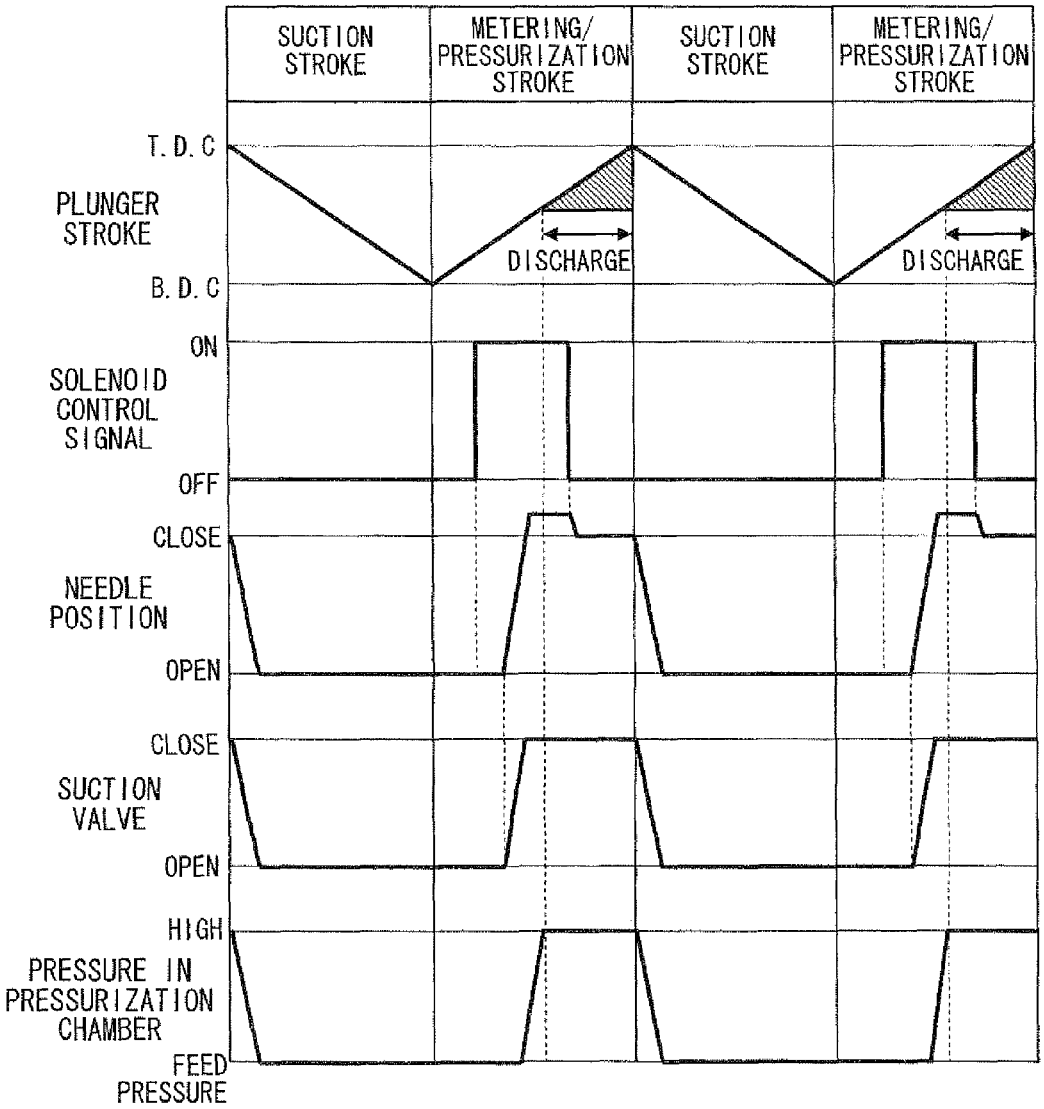
FIG. 5 is a chart showing an operation of the high-pressure pump according to the first embodiment.

Referring to FIGS. 2 and 5, an operation of the high-pressure pump 10 will be described hereinafter.

(1) Suction Stroke

When the plunger 13 slides down from the top dead center toward the bottom dead center, the volume of the pressurization chamber 121 is increased. The discharge valve body 92 sits on the valve seat 95 to close the discharge passage 114. The suction valve body 35 receives a differential pressure between the pressurization chamber 121 and the supply passage 100 to be opened against the biasing force of the first spring 21. Since the coil 71 is not energized at this moment, the movable core 73 and the needle 38 moves rightward against the biasing force of the second spring 22. The needle 38 is brought into contact with the suction valve body 35 so that the suction valve body 35 is maintained to be opened. The fuel is suctioned from the low-pressure fuel passage 101 to the pressurization chamber 121.

It should be noted that a control signal transmitted from the ECU 2 to the coil 71 is referred to as a solenoid control signal and a position of the needle 38 is referred to as a needle position in FIG. 5.

In the suction stroke, the plunger 13 slides down and the volume of the variable volume chamber 122 is decreased. The fuel in the variable volume chamber 122 is discharged into the damper chamber 201 through the cylindrical space 80 and the communication passage 83. At this moment, the fuel flows along an outer surface of the cylinder 14 from the second cylindrical space 82 to the first cylindrical space 81, so that the cylinder 14 is cooled by the fuel.

A ratio of cross sectional area between the large-diameter portion 133 and the variable volume chamber 122 is about "1:0.6". Thus, a ratio between an increased volume of the pressurization chamber 121 and a decreased volume of the variable volume chamber 122 is "1:0.6". About 60% of the fuel suctioned into the pressurization chamber 121 is supplied from the variable volume chamber 122 through the cylindrical space 80 and the low-pressure fuel passage 101, and about 40% of the fuel is suctioned from the fuel inlet. Thus, a suction efficiency of the fuel to the pressurization chamber 121 is improved.

(2) Metering Stroke

When the plunger 13 slides up from the bottom dead center toward the top dead center, the volume of the pressurization chamber 121 is decreased. At this moment, since the coil 71 is not energized, the needle 38 and the suction valve body 35 are biased rightward in FIG. 2. The supply passage 100 is maintained to be opened. Thus, the fuel in the pressurization chamber 121 is returned to the low-pressure fuel passage 101 through the suction valve 30. The pressure in the pressurization chamber 121 does not increase.

While the plunger 13 slides up from the bottom dead center to the top dead center, the coil 71 is energized according to a control signal from the ECU 2. The coil 71 generates magnetic field and magnetic attraction force is generated between the fixed core 72 and the movable core 73. When this magnetic attraction force becomes greater than the biasing force of the first and second springs 21, 22, the movable core 73 and the needle 38 move toward the fixed core 72. The suction valve body 35 sits on the valve seat 34 to close the supply passage 100.

(3) Pressurization Stroke

From the time the suction valve body 35 sits on the valve seat 34, the fuel pressure in the pressurization chamber 121 increases while the plunger 13 slides up. When the fuel pressure in the pressurization chamber 121 exceeds a specified value, the discharge valve body 92 moves away from the valve seat 95. Thereby, high-pressure fuel pressurized in the pressurization chamber 121 is discharged from the fuel outlet 91 through the discharge passage 114.

It should be noted that the coil 71 is deenergized in the pressurization stroke. The suction valve body 35 is maintained to be closed.

In the metering stroke and the pressurization stroke, the plunger 13 slides up and the volume of the variable volume chamber 122 increases. Therefore, the fuel in the damper chamber 201 flows into the variable volume chamber 122 through the communication passage 83 and the cylindrical space 80. Since the fuel in the damper chamber 201 has low temperature, the space around the cylinder 14 is filled with low-temperature fuel, whereby the cylinder 14 is cooled.

At this time, about 60% of the fuel discharged into the damper chamber 201 from the pressurization chamber 121 is suctioned into the variable volume chamber 122 from the damper chamber 201 through the communication passage 83 and the cylindrical space 80. Thereby, fuel pressure pulsation is reduced about 60%.

The ECU 2 controls a timing at which the coil 71 is energized, whereby the discharge quantity of the high-pressure pump 10 is adjusted.

According to the above embodiment, following functional advantages can be achieved.

The cylindrical space 80 is coaxially formed around the cylinder 14. This cylindrical space 80 communicates with both the variable volume chamber 122 and the low-pressure fuel passage 101. Thus, while the plunger 13 reciprocates, the fuel is introduced into the cylindrical space 80 alternately from the low-pressure fuel passage 101 and the variable volume chamber 122. The cylindrical space 80 is always filled with the fuel of low temperature. The entire outer surface of the cylinder 14 can be surely cooled.

Further, the volume of the first cylindrical space 81 is greater than that of the second cylindrical space 82. The first cylindrical space 81 has high cooling capacity. The fuel flows fast in the second cylindrical space 82. In a case heat is generated around the variable volume chamber 122, the cylinder 14 is cooled by the fuel in the second cylindrical space 82. This generated heat is axially transferred along the cylinder 14 so as to be cooled by the fuel in the first cylindrical space 81. Thus, the cylinder 14 is effectively cooled.

Thermal conductivity of gasoline is 0.01-0.07 kcal/m·h·□, which is rather smaller than that of metallic material. Thus, the heat transferred form the engine head to the pump body 11 and the heat which the pump body 11 receives from an engine room are hardly transferred to the cylinder 14 from the pump body 11 due to the fuel flowing in the cylindrical space 80.

[Second Embodiment]

Figure 6:
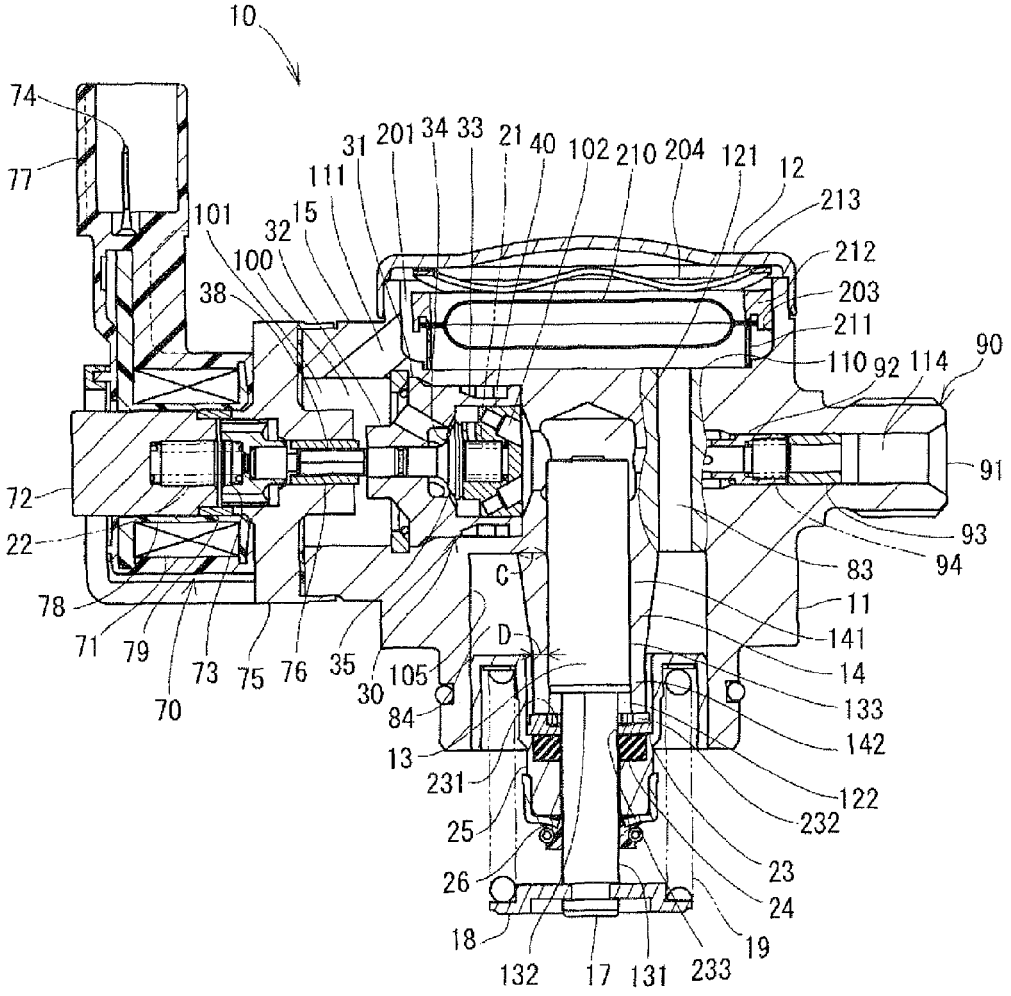
FIG. 6 is a cross-sectional view showing a high-pressure pump according to a second embodiment of the invention.

Referring to FIG. 6, a second embodiment of the invention will be described. In each of following embodiments, the substantially same parts and the components as those in the first embodiment are indicated with the same reference numeral and the same description will not be reiterated.

In the second embodiment, the cylindrical space 84 is shaped tapered. The cylinder 14 has a tapered portion 141 and a cylindrical portion 142. A wall thickness "C" of the cylinder 14 is thicker than a wall thickness "D" of the cylinder 14.

A fuel film is formed in a clearance between the cylinder 14 and the plunger 13. In this clearance, the fuel pressure decreases along a direction from the pressurization chamber 121 to the variable volume chamber 122 according to Hagen-Poiseuille equation. Corresponding to the variation in fuel pressure, the cylinder 14 has a tapered portion 141 so that a deformation of the cylinder 14 is restricted. Thereby, frictional heat is restricted between the cylinder 14 and the plunger 13.

[Third Embodiment]

Figure 7:
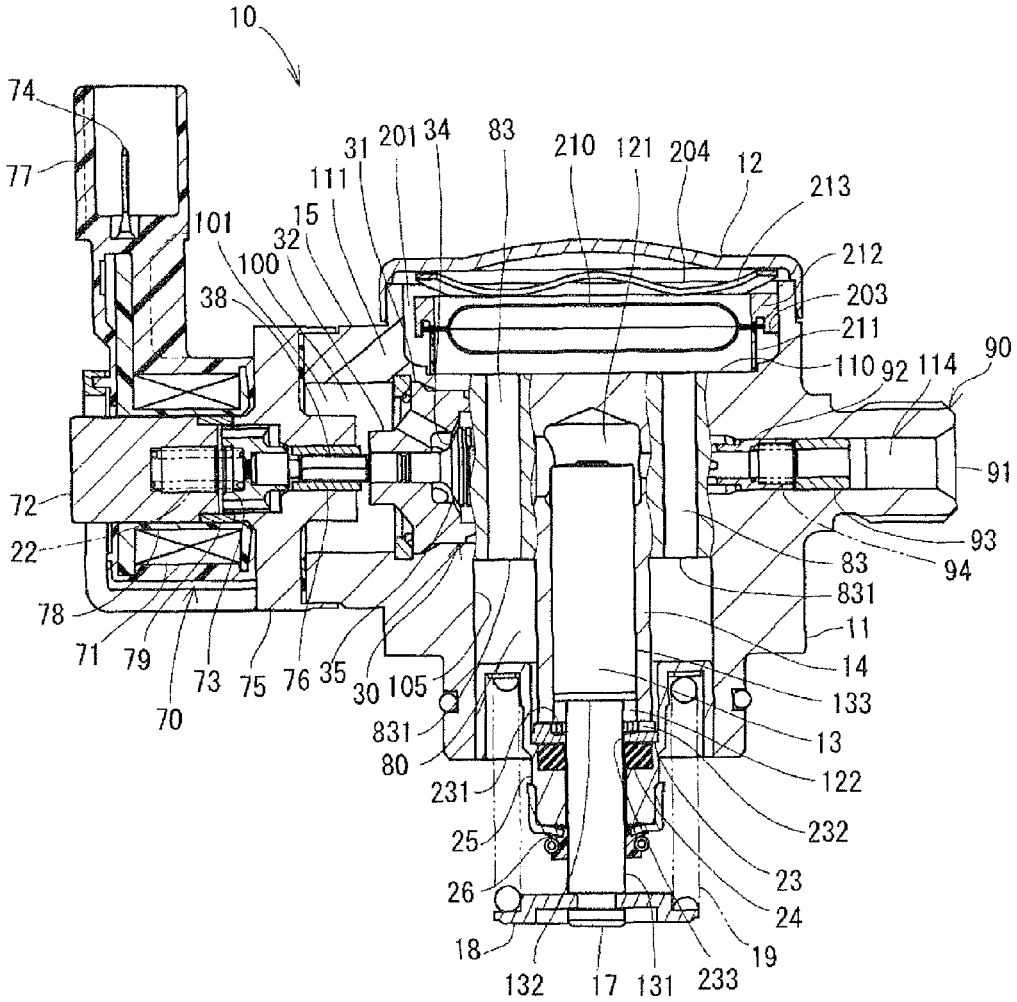
FIG. 7 is a cross-sectional view showing a high-pressure pump according to a third embodiment of the invention.

Referring to FIG. 7, a third embodiment of the invention will be described. A plurality of communication passages 83 hydraulically connecting the cylindrical space 80 and the damper chamber 201 are formed. These communication passages 83 extend axially in parallel with the cylinder 14. Each of communication passages 83 has an opening 831 which opens to the cylindrical space 80.

While the plunger 13 reciprocates and the volume of the variable volume chamber 122 is varied, the fuel circulates between the variable volume chamber 122 and the cylindrical space 80. The fuel circulates between the cylindrical space 80 and the damper chamber 201 through the openings 831 and communication passages 83. The fuel of low temperature is supplied from the fuel tank 1 to the damper chamber 201.

Thus, the variable volume chamber 122 and the cylindrical space 80 are filled with the fuel of low temperature.

The communication passages 83 improve the circulation of the fuel between the cylindrical space 80 and the damper chamber 201. Thus, since the fuel in the cylindrical space 80 becomes low temperature, it is restricted that heat is transferred from the pump body 11 to the cylinder 14. The cylinder 14 is effectively cooled.

[Fourth Embodiment]

Figure 8:
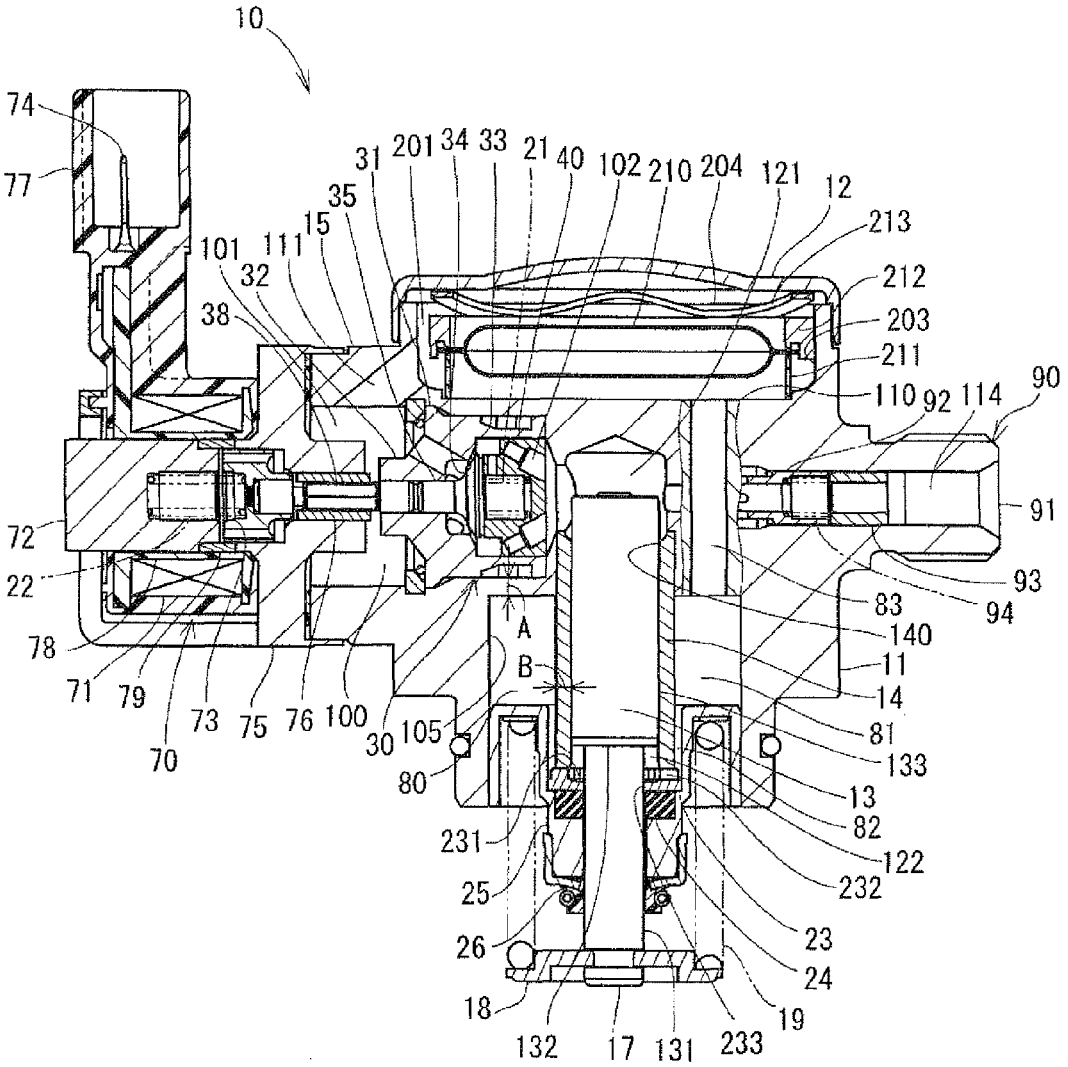
FIG. 8 is a cross-sectional view showing a high-pressure pump according to a fourth embodiment of the invention.

Referring to FIG. 8, a fourth embodiment of the invention will be described. In the present embodiment, the pump body 11 and the cylinder 14 are separately made. The cylinder 14 is press-fitted into the pump body 11. In the present embodiment, the cylinder 14 is made of martensite stainless steel which has relatively high hardness, and the pump body 11 is made of ferrite stainless of which hardness is lower than that of the cylinder 14. Thus, deformation of the cylinder 14 can be restricted. Also, a fuel leakage and a seizure between the cylinder 14 and the plunger 13 can be restricted. Further, the fuel passage can be easily formed in the pump body 11, which reduces manufacturing cost.

[Fifth Embodiment]

Figure 9:
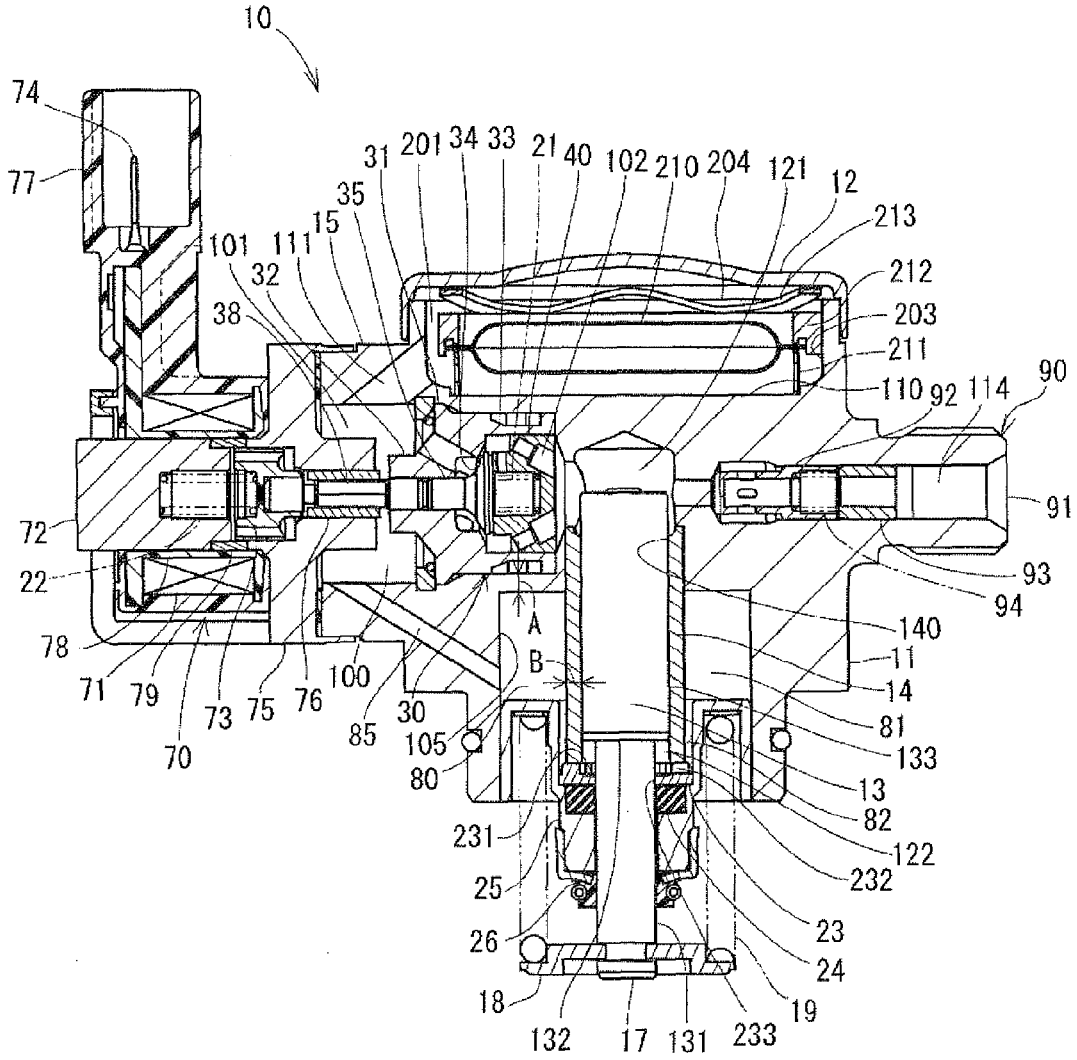
FIG. 9 is a cross-sectional view showing a high-pressure pump according to a fifth embodiment of the invention.

Referring to FIG. 9, a fifth embodiment of the invention will be described. A communication passage 85 hydraulically connects the cylindrical space 80 and the supply passage 100. In the metering stroke, the fuel discharged from the pressurization chamber 121 to the supply passage 100 is introduced into the variable volume chamber 122 through the supply passage 100, the communication passage 85 and the cylindrical space 80 without flowing into the damper chamber 201. Therefore, since the flow resistance between the pressurization chamber 121 and the variable volume chamber 122 becomes smaller, a suction efficiency from the pressurization chamber 121 to the variable volume chamber 122 can be enhanced.

A differential quantity of fuel between the fuel discharge from the pressurization chamber 121 and the fuel suctioned into the variable volume chamber 122 flows into the damper chamber 201. Thereby, the fuel pressure pulsation transmitted to the damper chamber 201 can be decreased.

In the suction stroke, the volume of the variable volume chamber decreases. The fuel discharged from the variable volume chamber 122 into the supply passage 100 through the cylindrical space 80 and the communication passage 85 can flow into the pressurization chamber 121 along a shortest pass. Thus, a suction efficiency of the fuel from the variable volume chamber 122 to the pressurization chamber 121 is improved. The fuel flows in the cylindrical space 80 efficiently and the cylinder 14 is effectively cooled.

[Sixth Embodiment]

Figure 10:
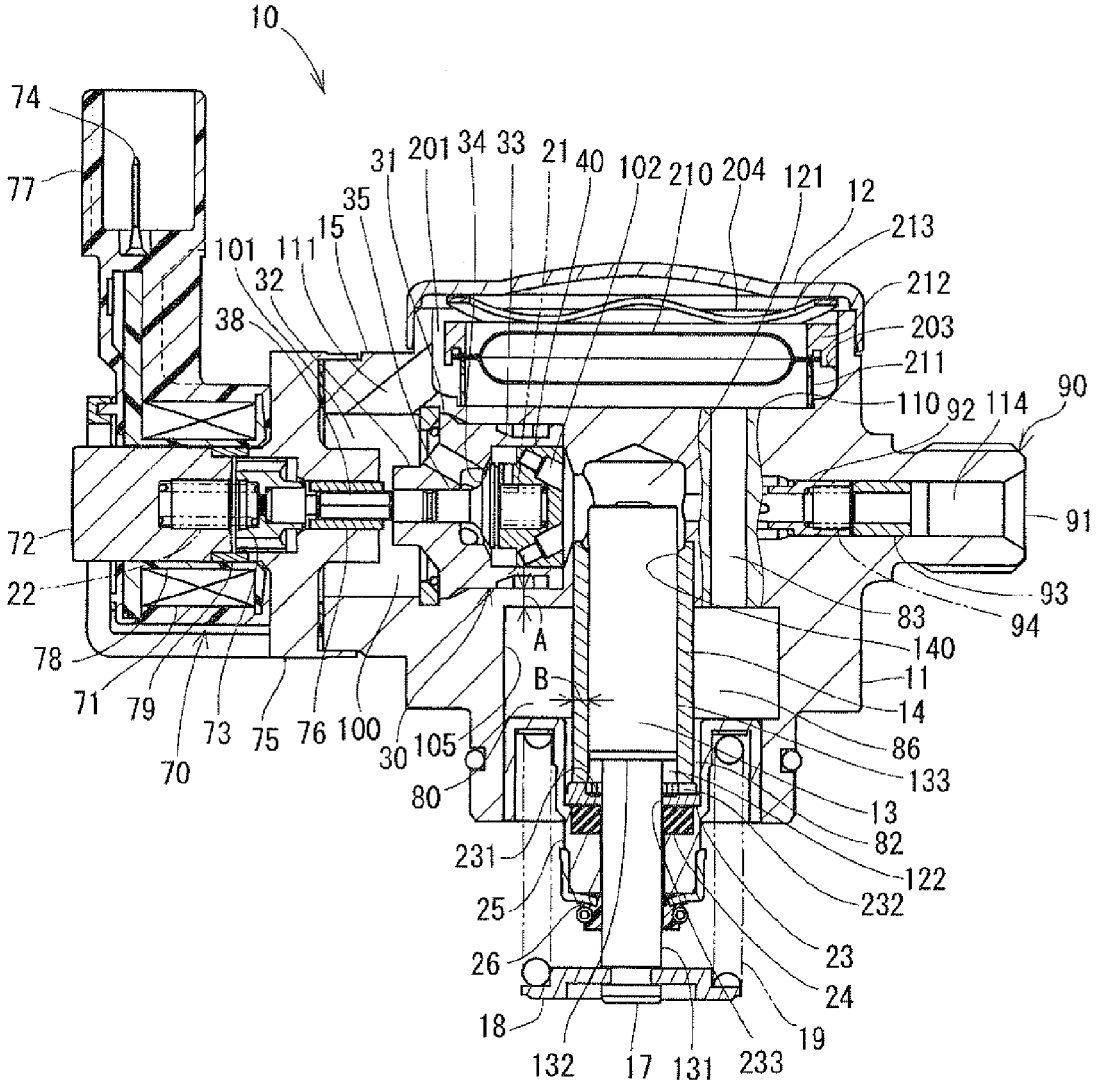

Referring to FIG. 10, a tenth embodiment of the invention will be described. A center line of the first cylindrical space 86 is made eccentric relative to a center line of the cylinder 14. Thus, the volume of the first cylindrical space 86 can be made larger, whereby the cylinder 14 is cooled more effectively.

[Seventh Embodiment]

FIG. 11 shows a seventh embodiment of the invention. In the seventh embodiment, the first cylindrical space 87 is shaped tapered.

Also in the seventh embodiment, the same advantages as those in the sixth embodiment can be obtained.

[Eighth Embodiment]

Referring to FIG. 12, an eighth embodiment of the invention will be described. The cylinder 14 is formed separately from the pump body 11 and is shaped tapered. The cylinder 14 is comprised of a large-diameter portion 143, a taper portion 144 and a small-diameter portion 145. A wall thickness "C" of the taper portion 144 is greater than a wall thickness "D" of the taper portion 144.

In the clearance between the cylinder 14 and the plunger 13, the fuel pressure decreases along a direction from the pressurization chamber 121 to the variable volume chamber 122. Corresponding to this variation in fuel pressure, the cylinder 14 has a tapered portion 144 so that a deformation of the cylinder 14 is restricted. Thereby, frictional heat is restricted between the cylinder 14 and the plunger 13.

Further, when the large-diameter portion 143 is press-inserted into the pump body 11, it is restricted that the large-diameter portion 143 is deformed in a radial direction.

[Other Embodiment]

The shape of cross section of the cylindrical space is not limited to the above embodiments. Any shape of cross section of the cylindrical space can be applied.

The present invention is not limited to the embodiment mentioned above, and can be applied to various embodiments.

What is claimed is:

1. A high-pressure pump comprising:

a plunger for pressurizing a fuel;

a cylinder accommodating the plunger reciprocatably in its axial direction, the cylinder having a large-diameter cylindrical portion, a tapered portion and a small-diameter cylindrical portion arranged sequentially in an axial direction of the cylinder, wherein the tapered portion has an increasing wall thickness that gradually increases in the axial direction of the cylinder toward a pressurization chamber, wherein each of the large-diameter cylindrical portion and the small-diameter cylindrical portion has a constant wall thickness, and wherein the small-diameter cylindrical portion is seamlessly and integrally connected to the tapered portion;

a pump body defining the pressurization chamber in which the fuel is pressurized by the plunger, a low-pressure fuel passage hydraulically connecting a fuel inlet and the pressurization chamber, and a discharge passage hydraulically connecting the pressurization chamber and a fuel outlet;

a suction valve opening/closing the low-pressure fuel passage;

a discharge valve opening/closing the discharge passage; and a variable volume chamber defined in the cylinder opposite to the pressurization chamber relative to the plunger, wherein a volume of the variable volume chamber is varied according to a reciprocation of the plunger; wherein the pump body further defines a cylindrical space around at least the small-diameter cylindrical portion of the cylinder, the cylindrical space communicates with the variable volume chamber and a communication passage extending from the low-pressure fuel passage, and the fuel flows into the cylindrical space from the low-pressure fuel passage so as to cool the cylinder.

2. A high-pressure pump according to claim 1, wherein the cylindrical space is comprised of a first cylindrical space with which the low-pressure fuel passage communicates and a second cylindrical space, the first cylindrical space and the second cylindrical space are aligned in an axial direction of the cylinder in such a manner that the first cylindrical space is close to the pressurization chamber more than the second cylindrical space, a volume of the first cylindrical space is greater than that of the second cylindrical space, and the fuel flows on outer surfaces of the tapered portion and the small-diameter cylindrical portion.

3. A high-pressure pump according to claim 2, wherein an inner diameter of the first cylindrical space is greater than that of the second cylindrical space, and the fuel flows into the variable volume chamber.

4. A high-pressure pump according to claim 1, wherein the cylinder has a wall thickness which is thick enough to endure a fuel pressure between the cylinder and the plunger.

5. A high-pressure pump according to claim 1, wherein the pump body defines a fuel passage hydraulically connecting the fuel inlet and the fuel outlet, and this fuel passage is arranged radially outside of the pressurization chamber.

6. A high-pressure pump according to claim 5, wherein the fuel passage is opened/closed by a suction valve or a discharge valve.

7. A high-pressure pump according to claim 1, further comprising a plurality of communication passages which hydraulically connect the cylindrical space and the low-pressure fuel passage.

8. A high-pressure pump according to claim 7, wherein the low-pressure fuel passage includes a damper chamber into which the fuel flows from the fuel inlet and a supply passage which hydraulically connects the damper chamber and the pressurization chamber, and the communication passages hydraulically connect the cylindrical space and the damper chamber.

9. A high-pressure pump according to claim 1, wherein a center axis of the cylindrical space is eccentric relative to a center axis of the cylinder.

10. A high-pressure pump according to claim 1, wherein the cylindrical space is tapered.

* * * * *